US008565466B2

(12) United States Patent
Kuhr

(10) Patent No.: US 8,565,466 B2
(45) Date of Patent: Oct. 22, 2013

(54) AUDITORY CANAL EARPHONE

(75) Inventor: Markus Kuhr, Singapore (SG)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 460 days.

(21) Appl. No.: 12/872,341

(22) Filed: Aug. 31, 2010

(65) Prior Publication Data

US 2011/0051980 A1 Mar. 3, 2011

(30) Foreign Application Priority Data

Sep. 3, 2009 (DE) ..... 10 2009 040 050

(51) Int. Cl.
*H04R 25/00* (2006.01)

(52) U.S. Cl.
USPC ..... 381/370; 381/322; 381/380; 381/381; 381/382

(58) Field of Classification Search
USPC ..... 381/380, 182, 382, 370, 322
See application file for complete search history.

(56) References Cited

U.S. PATENT DOCUMENTS 8,385,560 B2 * 2/2013 Solbeck et al. ..... 381/71.8

FOREIGN PATENT DOCUMENTS

| | | | |
|---|---|---|---|
| DE | 199 43 809 | A1 | 3/2001 |
| DE | 19943809 | A1 | 3/2001 |
| DE | 102007025446 | B3 | 11/2008 |
| DE | 10-2007-025446 | B3 | 12/2008 |

* cited by examiner

*Primary Examiner* — Davetta W Goins
*Assistant Examiner* — Amir Etesam
(74) *Attorney, Agent, or Firm* — Kilpatrick Townsend & Stockton LLP

(57) ABSTRACT

There is provided an auditory canal earphone comprising a housing (120) for receiving an electroacoustic transducer and a sound guide unit (130) on the housing (120) for feeding audio signals produced by the sound transducer into an auditory canal of a user of the auditory canal earphone. The sound guide unit (130) has an outside (136). The auditory canal further has at least one ear adaptor (200) with an inside wall (220) for at least partial placement over the sound guide unit (130) and an outside wall (210) for sealing off the auditory canal. The auditory canal earphone further has a tube (400) between the outside (136) of the sound guide unit (130) and the inside wall (220) of the ear adaptor (200).

7 Claims, 5 Drawing Sheets

AUDITORY CANAL EARPHONE

CROSS-REFERENCE TO RELATED APPLICATIONS

Figure 1A:
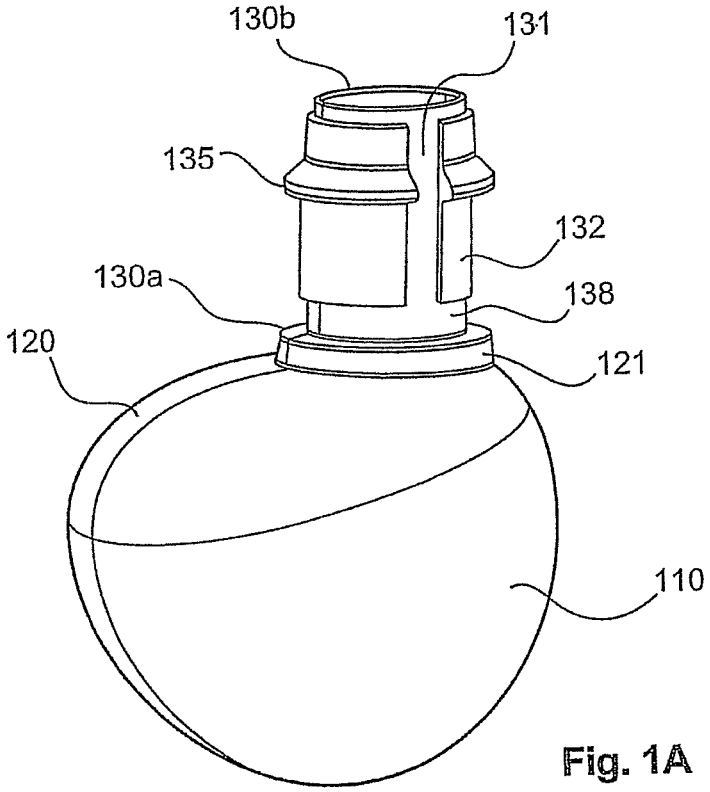

The present application claims priority to German Application No. 10 2009 040 050.8, filed Sep. 3, 2009, the entire contents of which are incorporated by reference in its entirety for all purposes.

The present invention concerns an auditory canal earphone.

Auditory canal earphones are in-ear earphones which are at least partially introduced into an auditory canal or an external hearing duct. Such auditory canal earphones are already known and typically have a sound guide unit as well as an ear adaptor which are at least partially introduced into the auditory canal.

It is desirable in the case of such auditory canal earphones to be able to at least partially adjust their acoustic properties.

Thus an object of the present invention is to provide an auditory canal earphone which has improved adjustment options for the acoustic properties of the earphone.

That object is attained by an auditory canal earphone as set forth in claim 1.

Thus there is provided an auditory canal earphone comprising a housing for receiving an electroacoustic transducer and a sound guide unit on the housing for feeding audio signals produced by the sound transducer into an auditory canal of a user of the auditory canal earphone. The sound guide unit has an outside. The auditory canal further has at least one ear adaptor with an inside wall for at least partial placement over the sound guide unit and an outside wall for sealing off the auditory canal. The auditory canal earphone further has a tube between the outside of the sound guide unit and the inside wall of the ear adaptor.

In an aspect of the present invention there is provided a slot at the outside of the sound guide unit or at the inside wall of the ear adaptor. That slot can provide a part of the tube.

In a further aspect of the present invention the inside wall can be of a first or a second length. The first end of the tube remains open when the inside wall is of a first length. The first end of the tube is closed when the inside wall is of a second length.

In a further aspect of the present invention there is provided a first ear adaptor with a first length of the inside wall or a second ear adaptor with a second length of the inside wall. The first ear adaptor leaves an end of the tube open when the ear adaptor is mounted on the sound guide unit. The second ear adaptor closes the tube or an end of the tube when the ear adaptor is mounted on the sound guide unit. The first ear adaptor has a first sound pattern and the second ear adaptor has a second sound pattern.

In that way the user can establish easily, more specifically by selecting the corresponding colour of the inside wall, the sound pattern that the auditory canal earphone is to provide.

The invention concerns the concept of providing between a sound guide unit and an ear adaptor or ear pad which is placed thereover, a tube which influences a flow of air. In other words, there is a flow of air along the length of the tube or along the length of the sound guide unit. A slot at the outside of the sound guide unit or a slot at the inside wall of the ear adaptor can represent a further part of the tube. A further part of the tube can then represent either the inside wall of the ear adaptor or the outside of the sound guide unit. The length of the tube and thus the acoustic properties or the sound pattern of the auditory canal earphone can be influenced by the choice of different ear adaptors (in particular with differing lengths for the inside wall). Thus there can be provided an ear adaptor having a first length of the inside wall and a second ear adaptor having a second length of the inside wall. For example the length of the inside wall of the second ear adaptor can be so selected that the tube is closed on the side towards the housing of the auditory canal earphone while the opposite end is not closed.

Further configurations of the invention are subject-matter of the appendant claims.

Advantages and embodiments by way of example of the invention are described in greater detail hereinafter with reference to the drawing.

Figure 1B:
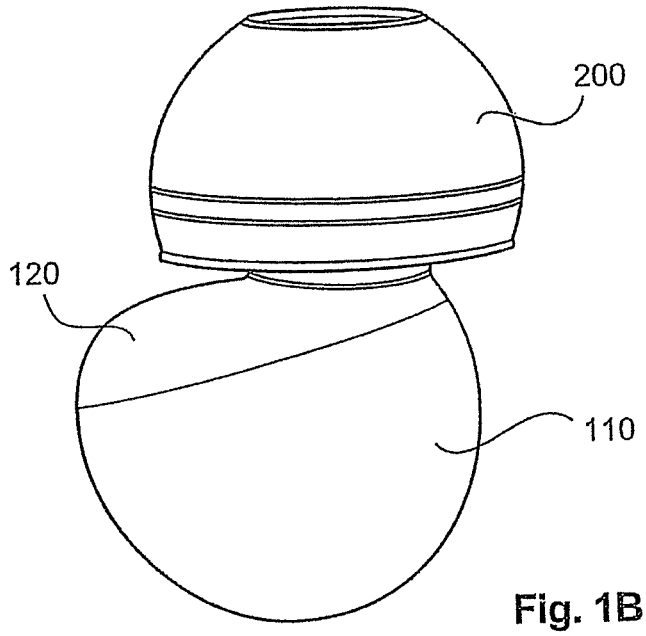
Figure 2A:
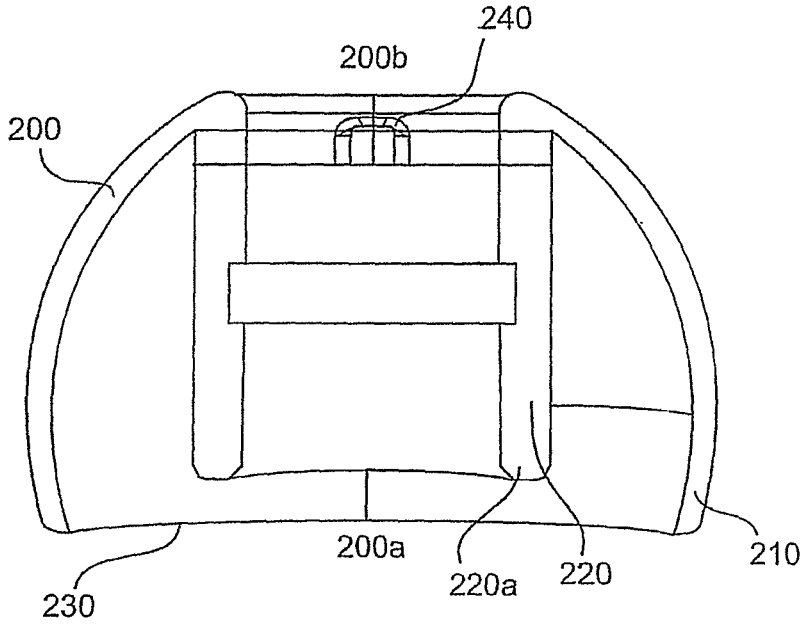
Figure 2B:
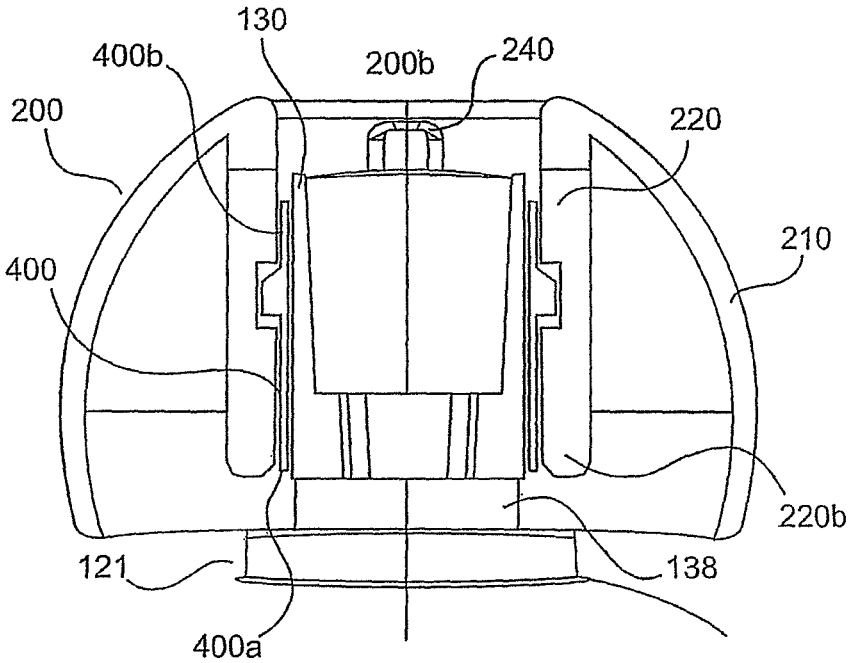
Figure 3A:
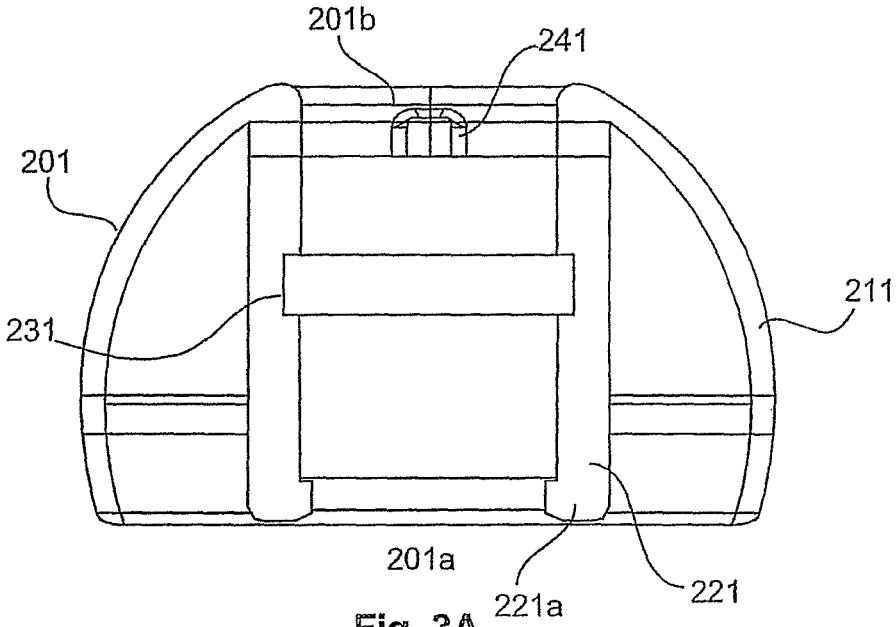
Figure 3B:
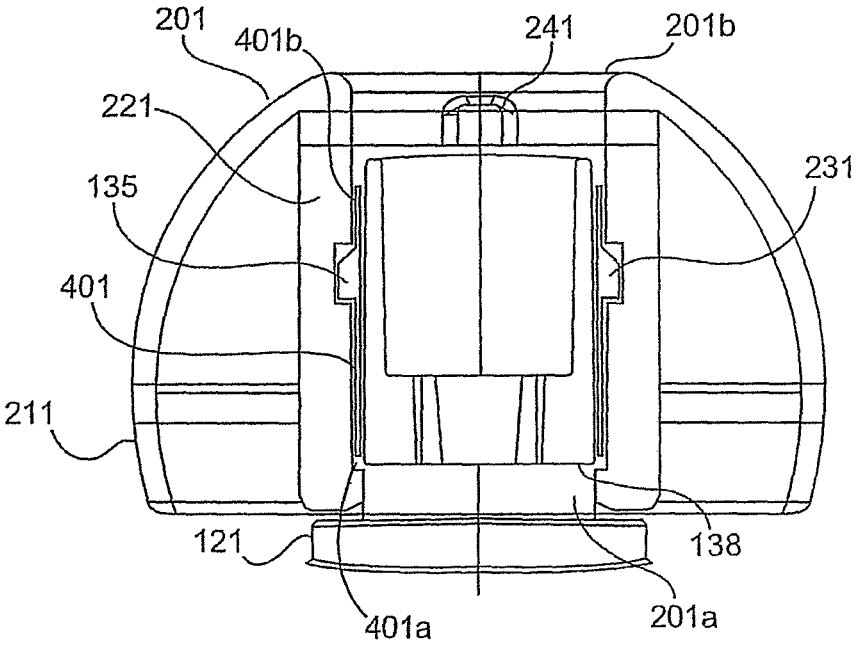
Figure 4:
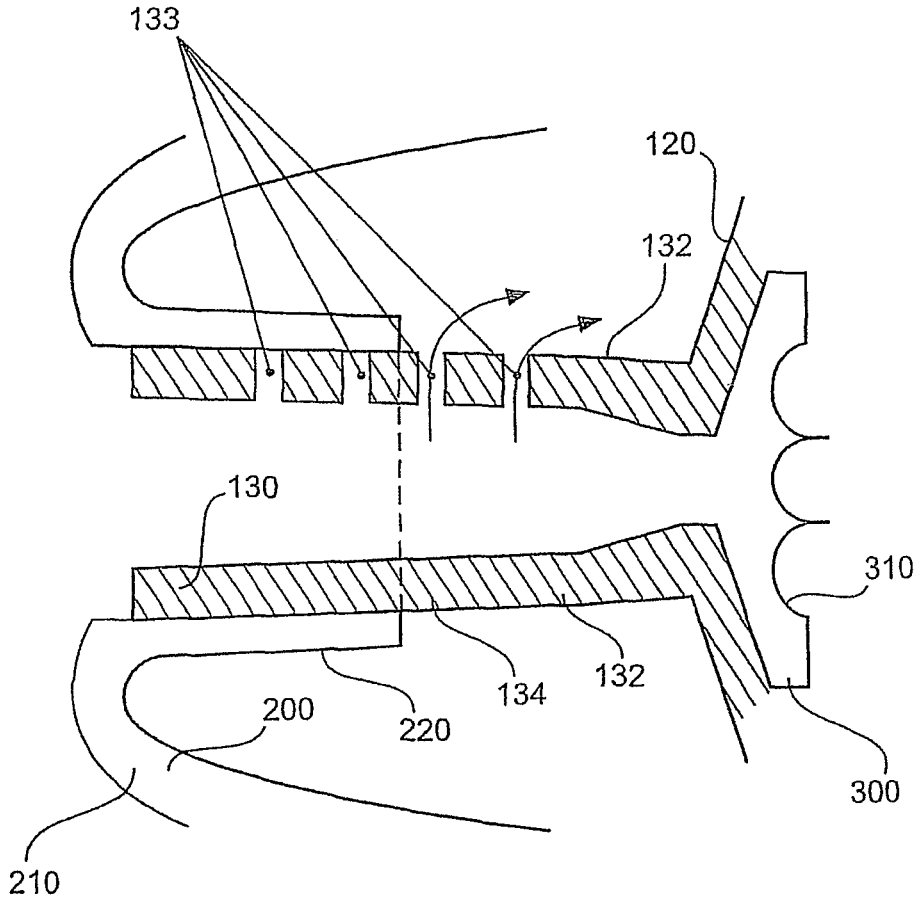
Figure 5:
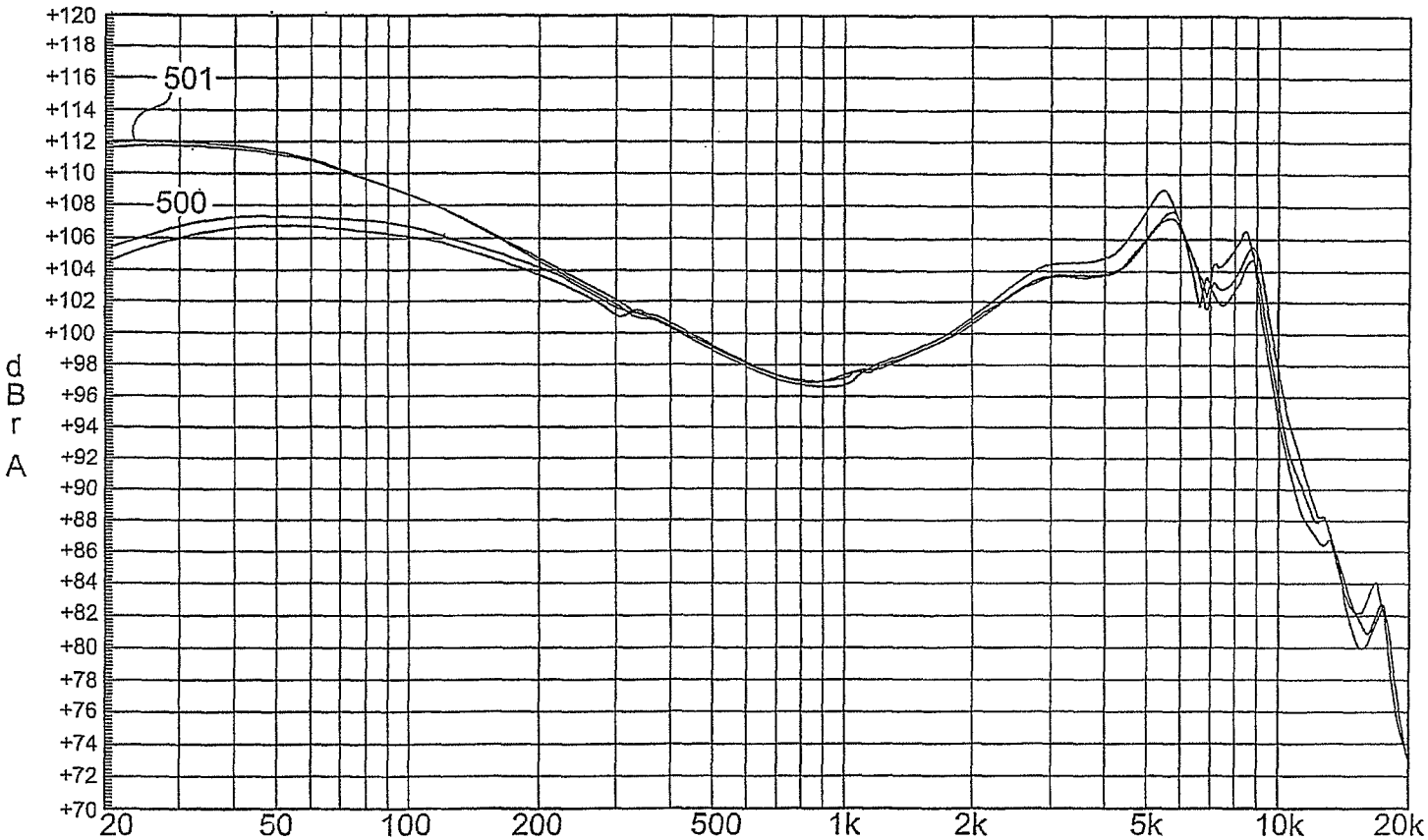

FIG. 1A shows a perspective view of an auditory canal earphone in a first embodiment, FIG. 1B shows a perspective view of the auditory canal earphone of FIG. 1A with an ear adaptor, FIG. 2A shows a cross-section of an ear adaptor in a second embodiment, FIG. 2B shows a cross-section of an auditory canal earphone in a second embodiment, FIG. 3A shows a cross-section of an ear adaptor in a third embodiment, FIG. 3B shows a cross-section of a part of an auditory canal earphone in a third embodiment, FIG. 4 shows a diagrammatic view in section of an auditory canal earphone in a fourth embodiment, and FIG. 5 shows a graph of the frequency characteristic of the above-described auditory canal earphones.

Auditory canal earphones according to the invention are earphones which are at least partially introduced into an auditory canal or an external hearing duct of a user and the sound produced is then delivered directly into the auditory canal or the external hearing duct of the user.

FIGS. 1A and B each show a perspective view of an auditory canal earphone in accordance with the first embodiment. FIG. 1A shows the auditory canal earphone and FIG. 1B shows the auditory canal earphone including an ear adaptor. The auditory canal earphone has a housing having a first and a second housing half 110, 120. A sound guide unit 130 is provided on the second housing half. A first end 130*a* of the sound guide unit 130 is fixed to a (round) projection 121 (end abutment) of the second housing half 120. A second end 130*b* of the sound guide unit 130 (the free end) serves to be introduced into an auditory canal of a user.

At its outside 132 the sound guide unit 130 has an elongate slot 131 and a ridge or radial projection 135 which is interrupted by the slot 131. Optionally a plurality of slots 131 can be provided distributed over the periphery of the sound guide unit 130.

The first and second housing halves 110, 120 serve to receive a sound transducer 300.

In FIG. 1B an ear cushion or ear adaptor 120 is placed over the sound guide unit 130. The sound guide unit 130 with the ear adaptor 200 placed thereover can be at least partially introduced into an auditory canal or an external hearing duct of a user.

A peripherally extending recess or depression 138 can be provided at the first end of the sound guide unit 130.

FIGS. 2A and 2B show cross-sections of an ear adaptor or auditory canal earphone in accordance with the second embodiment. The auditory canal earphone in accordance with the second embodiment can for example be based on the auditory canal earphone in accordance with the first embodiment.

FIG. 2A shows a cross-section of an ear adaptor 200 in accordance with the second embodiment. The ear adaptor has an outside wall 210 and an inside wall 220. The ear adaptor has a first end 200*a* and a second end 200*b*. The first end 200*a* is placed over the sound guide unit 130 and the second end 200*b* can be introduced into the auditory canal or the external hearing duct. An at least partially peripherally extending groove 230 can be provided at the inside wall 210. That groove 230 is of such a configuration that it can be placed over the projection 135 of the sound guide unit. In that way the ear adaptor 200 can be securely placed on the sound guide unit 130. The inside wall 220 can be of a first length 220*a*. The inside wall 220 and the outside wall 210 are connected together at the second end 200*b* of the ear adaptor 200.

FIG. 2B shows a diagrammatic view in section of a part of an auditory canal earphone in accordance with the second embodiment. In particular FIG. 2B shows a sectional view of the sound guide unit 130 and an ear adaptor 200 placed thereon. The ear adaptor 200 is placed on the sound guide unit 130 or the ear adaptor 200 has been pushed or fitted on over the sound guide unit 130. The inside wall 220 has a groove 230 in which the peripherally extending projection 135 is placed.

At least one tube 400 is provided between the outside 132 of the sound guide unit 130 and the inside wall 120 of the ear adaptor. That tube 400 is formed on the one hand by the slot 131 and on the other hand by the inside wall 220 of the ear adaptor. Thus a tube 400 is provided along the first length 220*a* of the inside wall 220. The first end 400*a* of the tube is disposed above the projection 121, a first spacing relative to the projection 121 remaining so that the first end 400*a* of the tube is opened. The second end 400*b* of the tube 400 is disposed at the second end of the ear cushion or ear adaptor 200, the second end (400*b*) also being opened. In particular there is a first spacing from the second end of the ear cushion or the ear adaptor. Thus a flow of air can occur along the at least one tube 400 so that the volume enclosed by the ear of the user and the auditory canal earphone, when the auditory canal earphone is being worn in the ear or in the external hearing duct of the user, is connected to the outside world by way of the tube 400. FIG. 2*b* shows for example two elongate slots 131 in the sectional view of the sound guide unit 130.

At its second end 200*b* the ear adaptor can have a limb 240 which extends radially. The limb can prevent the ear adaptor 200 being pushed excessively far over the sound guide unit 130.

A peripherally extending depression or recess 138 can be provided at the first end of the sound guide unit 130. That peripherally extending recess can ensure for example that the first end 400*a* of the tube or groove 400 remains open.

In the second embodiment therefore the first end 400*a* of the tube 400 is open.

FIGS. 3A and 3B show sectional views of an auditory canal earphone in accordance with the third embodiment. The auditory canal earphone in accordance with the third embodiment can be based on the auditory canal earphone in accordance with the first or second embodiment.

FIG. 3A shows a sectional view of an ear adaptor in accordance with a third embodiment. The ear adaptor 201 has an outside wall 211 and an inside wall 221. The ear adaptor has a first end 201*a* and a second end 201*b*. The first end 201*a* is placed over the sound guide unit 130 and the second end 201*b* can be introduced into the auditory canal or into the external hearing duct. An at least partially peripherally extending groove 231 can be provided at the inside wall 221. That groove 231 is of such a configuration that it can be placed over the projection or end abutment 121 of the sound guide unit. In that way the ear adaptor 201 can be securely placed on the sound guide unit 130. The inside wall 221 can be of a first length 221*b*. The inside wall 221 and the outside wall 211 are connected together at the second end 201*b* of the ear adaptor 201.

The ear adaptor 201 can optionally have a limb 241 at the second end 201*b* of the ear adaptor. That limb is radial and serves to prevent the ear adaptor being pushed excessively far on to the sound guide unit 130.

FIG. 3B shows a diagrammatic sectional view of a part of an auditory canal earphone in accordance with the third embodiment. In particular FIG. 3 shows a diagrammatic sectional view of the sound guide unit 130 and the ear adaptor 201. The ear adaptor 201 is placed on the sound guide unit 130 or the ear adaptor 200 is pushed or fitted on over the sound guide unit 130. The inside wall 221 has a groove 231 in which the peripherally extending projection 135 is placed.

The inside wall 221 extends as far as the projection 121 and thus closes the first end 401*a* of the tube 401 so that the volume enclosed by the ear of the user and the auditory canal earphone when the auditory canal earphone is being worn in the ear or in the external hearing duct of a user is closed in relation to the outside world. At its first end 101*a* the inside wall 221 can have a constriction to ensure reliable closure of the tube 401.

A peripherally extending projection or recess 138 can be provided at the first end of the sound guide unit 130. By virtue of the configuration of the inside wall 121 of the ear adaptor 201 an end of the inside wall is disposed in or against the peripherally extending recess 138.

FIG. 4 shows a sectional view of an auditory canal earphone in accordance with the fourth embodiment. In particular there are a sound guide unit 130 and an ear adaptor 200. The sound guide unit 130 has an outside 132 and a plurality of bores 133. The ear adaptor 200 is pushed or fitted on with its inside wall 220 over the sound guide unit 130. At its outside 132 the sound guide unit 130 can have a projection 134. That projection 134 serves as a stop unit for the pushed-on cushion, that is to say a first end of the cushion can only be pushed as far as the projection 134. The pushed-on or fitted-over inside wall 120 of the ear adaptor 200 can close at least a number of bores 133. A number of bores is closed in dependence on the length with which the inside wall is pushed on to the sound guide unit. In that respect, in the extreme case, all bores 133 can be opened or in the complementary case, all bores 133 can be closed.

FIG. 5 shows a graph of the frequency characteristic of the above-described auditory canal earphones. FIG. 5 shows a first measurement curve 500 which is to be measured in relation to an ear adaptor 200 in accordance with the second embodiment, that is to say with an open tube 400. FIG. 5 also shows a second measurement curve 501 which is to be measured in relation to an ear adaptor 201 in accordance with the third embodiment, that is to say with a closed tube 400. Due to the tube 400 being closed with the ear adaptor 201 in accordance with the third embodiment, the associated second measurement curve 501 has a lift in the bass frequency range from about 20 Hz to 200 Hz by up to 6 dB in relation to the first curve 500 with measurement with the open tube using the ear adaptor in accordance with the second embodiment. The user thus has a choice for example between the ear adaptor 200 of the second embodiment and the ear adaptor 201 of the third embodiment, that is to say the user has a choice between the sound pattern in accordance with the first curve 500 and the sound pattern in accordance with the second measurement curve 501. The various ear adaptors 200, 201 in accordance with the first or second embodiments can be identified in different colours so that the user can better distinguish them.

The sound guide unit can be in the form of a tube. The ear adaptor can be made from silicone or can be provided in the form of a foam cushion of rubber, foam material or a similar flexible material. A sound passage can be provided by the tube member or the tube. That sound passage can have an acoustic resistance and at the same time an inductive component so that an acoustic low pass filter can be defined in the auditory passage volume. The acoustic resistance of the acoustic low pass filter can be altered in dependence on the coverage of the sound passage by the ear adaptor.

In the first embodiment the sound passage is in the form of a long slot. The length of the slot or the sound passage can be opened or closed in accordance with the length of the inside wall of the ear adaptor.

In accordance with the fourth embodiment bores can be provided in the sound guide unit. Those bores can be at least partially covered or left open by the ear adaptor.

In a further embodiment of the invention a bore can be provided in the sound guide unit. In addition thereto an opening or bore can also be provided at the inside wall of the ear adaptor. That opening can be for example of a triangular configuration. In that way the effective size of the hole can be steplessly varied by rotation of the ear adaptor.

In a further embodiment of the invention the length of the tube can be varied (steplessly) by the ear adaptor being slid or displaced along the sound guide unit.

The auditory canal earphone according to the invention can have a groove (between the sound guide unit and the ear adaptor), through which sound guidance can be effected. The groove can act as part of an acoustic low pass so that the low-frequency characteristic is influenced. A user can choose for example between two different sound settings by means of the optionally interchangeable ear adaptors. When the groove or tube 400 is closed the sound level is then raised in the low-frequency range.

The invention claimed is:

1. An auditory canal earphone comprising:

at least one housing for receiving an electroacoustic sound transducer;

a sound guide unit on the housing for feeding audio signals produced by the sound transducer into an auditory canal of a user of the auditory canal earphone, wherein the sound guide unit has an outside;

at least one ear adaptor with an inside wall for at least partial placement over the sound guide unit and an outside wall for sealing off the auditory canal;

at least one tube between the outside of the sound guide unit and the inside wall of the ear adaptor; and a slot at the inside wall of the ear adaptor, the slot providing a part of the tube.

2. An earphone according to claim 1 and further comprising a slot at the outside of the sound guide unit, the slot forming a part of the tube.

3. An auditory canal earphone comprising:

at least one housing for receiving an electroacoustic sound transducer;

a sound guide unit on the housing for feeding audio signals produced by the sound transducer into an auditory canal of a user of the auditory canal earphone, wherein the sound guide unit has an outside;

at least one ear adaptor with an inside wall for at least partial placement over the sound guide unit and an outside wall for sealing off the auditory canal; and at least one tube between the outside of the sound guide unit and the inside wall of the ear adaptor, wherein a first ear adaptor having a first length of the inside wall or a second ear adaptor having a second length of the inside wall is provided, wherein the first end of the tube remains open when the inside wall is of the first length and the first end is closed when the inside wall is of the second length.

4. An auditory canal earphone comprising:

at least one housing for receiving an electro acoustic sound transducer;

a sound guide unit on the housing for feeding audio signals produced by the sound transducer into an auditory canal of a user of the auditory canal earphone, wherein the sound guide unit has an outside;

at least one ear adaptor with an inside wall for at least partial placement over the sound guide unit and an outside wall for sealing off the auditory canal;

at least one tube between the outside of the sound guide unit and the inside wall of the ear adaptor; and a first ear adaptor which leaves the tube open when it is mounted on the sound guide unit or an ear adaptor which closes the tube when it is mounted on the sound guide unit, wherein the first ear adaptor ensures a first sound pattern and the second ear adaptor ensures a second sound pattern, the first sound pattern differing from the second sound pattern.

5. An earphone according to claim 4 wherein the inside wall of the first ear adaptor is of a first color and the inside wall of the second ear adaptor is of a second color, the first color being different from the second color.

6. An auditory canal earphone comprising:

at least one housing for receiving an electro acoustic sound transducer;

a sound guide unit on the housing for feeding audio signals produced by the sound transducer into an auditory canal of a user of the auditory canal earphone, wherein the sound guide unit has an outside; and at least one ear adaptor with an inside wall and for at least partial placement over the sound guide unit and an outside wall for sealing off the auditory canal, wherein the sound guide unit has at least one through bore, and wherein the ear adaptor with its inside wall is placed over the sound guide unit and is adapted to close at least one of the bores in the wall of the sound guide unit.

7. An earphone according to claim 6 wherein at its outside the sound guide unit has an end abutment for the inside wall of the ear adaptor.

* * * * *

UNITED STATES PATENT AND TRADEMARK OFFICE

CERTIFICATE OF CORRECTION

PATENT NO. : 8,565,466 B2
APPLICATION NO. : 12/872341
DATED : October 22, 2013
INVENTOR(S) : Kuhr It is certified that error appears in the above-identified patent and that said Letters Patent is hereby corrected as shown below:

On the Title Page, item (57), In the Abstract:

In line 6, please delete "(136)".

In line 11, please delete "(136)".

In the Claims:

In column 6, line 17, claim 4, please delete "electro acoustic" and insert --electroacoustic--.

In column 6, line 40, claim 6, please delete "electro acoustic" and insert --electroacoustic--.

In column 6, line 50, claim 6, after "ear adaptor" please insert a --,--.

In column 6, line 50, claim 6, after "inside wall" please insert a --,--.

In column 6, line 53, claim 7, after "wherein" please insert a --,--.

In column 6, line 53, claim 7, after "outside" please insert a --,--.

Signed and Sealed this
Sixth Day of May, 2014

Michelle K. Lee

Michelle K. Lee
*Deputy Director of the United States Patent and Trademark Office*